US010690416B2

(12) United States Patent
Katsumata

(10) Patent No.: US 10,690,416 B2
(45) Date of Patent: Jun. 23, 2020

(54) HEAT TREATMENT DEVICE

(71) Applicants: IHI Corporation, Tokyo (JP); IHI Machinery and Furnace Co., Ltd., Tokyo (JP)

(72) Inventor: Kazuhiko Katsumata, Inuyama (JP)

(73) Assignees: IHI CORPORATION, Tokyo (JP); IHI MACHINERY AND FURNACE CO., LTD., Tokyo (JP)

( * ) Notice: Subject to any disclaimer, the term of this patent is extended or adjusted under 35 U.S.C. 154(b) by 260 days.

(21) Appl. No.: 15/677,100

(22) Filed: Aug. 15, 2017

(65) Prior Publication Data

US 2018/0010854 A1 Jan. 11, 2018

Related U.S. Application Data

(63) Continuation of application No. PCT/JP2016/056055, filed on Feb. 29, 2016.

(30) Foreign Application Priority Data

Apr. 22, 2015 (JP) ..... 2015-087450

(51) Int. Cl.

| | |
|---|---|
| ***F27D 9/00*** | (2006.01) |
| ***C21D 1/773*** | (2006.01) |
| ***C21D 1/767*** | (2006.01) |
| ***F27D 7/04*** | (2006.01) |
| ***F27B 5/04*** | (2006.01) |
| ***F27B 19/02*** | (2006.01) |
| ***F27B 5/02*** | (2006.01) |
| ***C21D 9/00*** | (2006.01) |

(52) U.S. Cl.
CPC ..... *F27D 9/00* (2013.01); *C21D 1/767* (2013.01); *C21D 1/773* (2013.01); *C21D 9/0062* (2013.01);
(Continued)

(58) Field of Classification Search
CPC ..... C21D 1/767; C21D 1/773; C21D 9/0062; F27B 19/02; F27B 5/02; F27B 5/04;
(Continued)

(56) References Cited

U.S. PATENT DOCUMENTS 3,168,607 A * 2/1965 Greene ..... C21D 1/74 266/250
5,362,031 A * 11/1994 Heilmann ..... C21D 1/767 266/252
(Continued)

FOREIGN PATENT DOCUMENTS

CN 103114190 A 5/2013
CN 203229561 U 10/2013
(Continued)

*Primary Examiner* — Scott R Kastler
*Assistant Examiner* — Michael Aboagye
(74) *Attorney, Agent, or Firm* — Rothwell, Figg, Ernst & Manbeck, P.C.

(57) ABSTRACT

A heat treatment device includes: a heat treatment chamber which accommodates an object to be treated; a cooling gas supply unit which supplies a cooling gas into the heat treatment chamber; a cooling gas circulation unit which circulates the cooling gas in the heat treatment chamber; and a gas purge unit which gas-purges, with an inert gas, a portion in which there is a possibility of mixing of the cooling gas supplied into the heat treatment chamber and an oxygen gas, in which the cooling gas supply unit supplies a hydrogen gas into the heat treatment chamber as the cooling gas.

9 Claims, 4 Drawing Sheets

(52) U.S. Cl.
CPC ..... *F27B 5/02* (2013.01); *F27B 5/04* (2013.01); *F27B 19/02* (2013.01); *F27D 7/04* (2013.01); *F27D 2007/045* (2013.01); *F27D 2009/0075* (2013.01)

(58) Field of Classification Search
CPC ..... F27D 2007/045; F27D 2009/0075; F27D 7/04; F27D 9/00
USPC ..... 266/89, 90, 249, 250, 251, 252
See application file for complete search history.

(56) References Cited

U.S. PATENT DOCUMENTS

| | | | | |
|---|---|---|---|---|
| 8,992,213 | B2 * | 3/2015 | Moller | F27B 5/04 126/99 R |
| 2007/0245698 | A1 | 10/2007 | Lomax, Jr. et al. | |
| 2010/0196836 | A1 | 8/2010 | Moller et al. | |
| 2012/0310421 | A1 | 12/2012 | Muhlhaus | |
| 2017/0307296 | A1 * | 10/2017 | Katsumata | C21D 1/00 |
| 2018/0016652 | A1 * | 1/2018 | Katsumata | C21D 1/767 |

FOREIGN PATENT DOCUMENTS

| | | | |
|---|---|---|---|
| JP | 58-147514 | A | 9/1983 |
| JP | 3-90510 | A | 4/1991 |
| JP | 5-230528 | A | 9/1993 |
| JP | 10-183236 | A | 7/1998 |
| JP | 11-153386 | A | 6/1999 |
| JP | 2001-255070 | A | 9/2001 |
| JP | 2005-16893 | A | 1/2005 |
| JP | 2007-27379 | A | 2/2007 |
| JP | 2010-181135 | A | 8/2010 |
| JP | 2012-251764 | A | 12/2012 |
| JP | 2013-181222 | A | 9/2013 |

* cited by examiner

HEAT TREATMENT DEVICE

This application is a continuation application based on a PCT Patent Application No.PCT/JP2016/056055, filed on Feb. 29, 2016, whose priority is claimed on Japanese Patent Application No. 2015-87450, filed on Apr. 22, 2015. The contents of both the PCT Application and the Japanese Application are incorporated herein by reference.

TECHNICAL FIELD

Embodiments described herein relates to a heat treatment device.

BACKGROUND ART

As a heat treatment device including a heat treatment chamber which accommodates an object to be treated, a cooling gas supply unit which supplies a cooling gas into the heat treatment chamber, and a cooling gas circulation unit which circulates the cooling gas in the heat treatment chamber, for example, a multi-chamber type multi-cooling vacuum furnace disclosed in the following Patent Document 1 is known. The multi-chamber type multi-cooling vacuum furnace includes a liquid nozzle and a gas nozzle disposed in a cooling chamber so as to surround the object to be treated and configured to supply a cooling liquid and a cooling gas.

CITATION LIST

Patent Documents

[Patent Document 1]
Japanese Unexamined Patent Application, First Publication No. H11-153386

SUMMARY

When a gas cooling operation is performed in a heat treatment process, an inert gas may be used as the cooling gas. The inert gas such as nitrogen gas, argon gas or the like may be used as the cooling gas, and in the gas cooling operation of so-called bright heat treatment, the nitrogen gas is generally used. When the nitrogen gas is used as the cooling gas, it is necessary to increase a gas density in order to enhance cooling capacity. However, when enhancement of the cooling capacity is pursued, a container capable of enduring a high pressure, a unit for increasing a pressure of the cooling gas or the like is required, and inspection of such facilities is also necessary.

The present disclosure was made in view of the above-described circumstances and has an object to provide a heat treatment device which is capable of enhancing cooling capacity even if a pressure of a cooling gas is reduced.

A first aspect of the present disclosure provides a heat treatment device including: a heat treatment chamber which accommodates an object to be treated; a cooling gas supply unit which supplies a cooling gas into the heat treatment chamber; a cooling gas circulation unit which circulates the cooling gas in the heat treatment chamber; and a gas purge unit which gas-purges, with an inert gas, a portion in which there is a possibility of mixing of the cooling gas supplied into the heat treatment chamber and an oxygen gas, in which the cooling gas supply unit supplies a hydrogen gas into the heat treatment chamber as the cooling gas.

In the present disclosure, hydrogen gas is used as a cooling gas, and an object to be treated is cooled by circulating the hydrogen gas in a heat treatment chamber. Since the hydrogen gas has a heat transfer rate of about 2.2 times that of nitrogen gas, cooling capacity can be enhanced even if a pressure of the cooling gas is reduced. Meanwhile, when the hydrogen gas is mixed with oxygen gas, the hydrogen gas may be ignited and burnt by even a slight spark. Therefore, by performing gas purging with the inert gas at a portion in which there is a possibility of mixing of the cooling gas supplied into the heat treatment chamber and the oxygen gas, mixing of the hydrogen gas and the oxygen gas at the portion can be reliably prevented. Accordingly, the hydrogen gas can be safely used as the cooling gas.

Therefore, according to the present disclosure, it is possible to obtain a heat treatment device which can enhance the cooling capacity even if the pressure of the cooling gas is reduced.

DESCRIPTION OF EMBODIMENTS

Hereinafter, an embodiment of the present disclosure will be described with reference to the drawings. A multi-chamber type heat treatment device is an exemplary example of a heat treatment device of the present disclosure.

Figure 1:
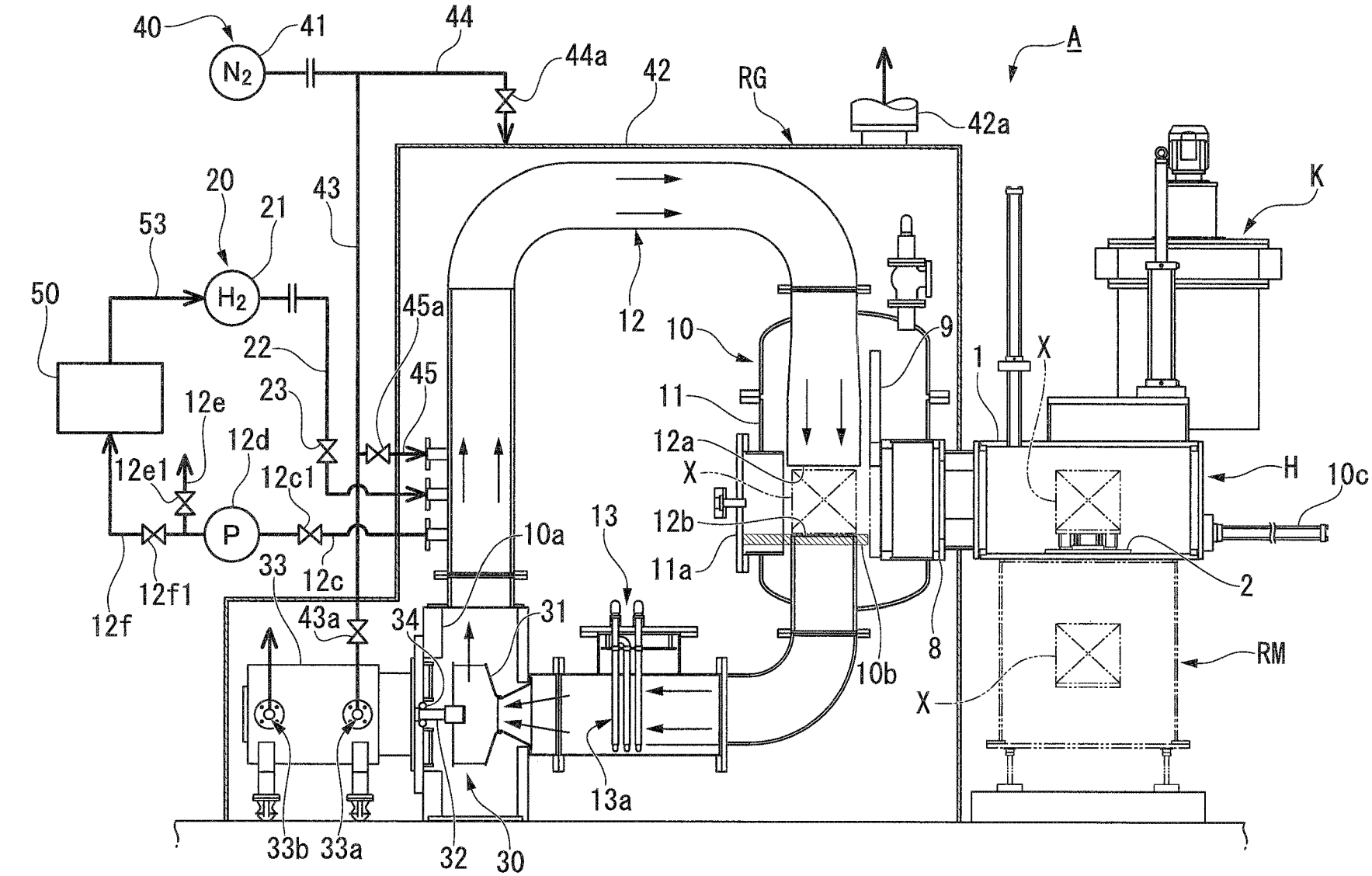
FIG. 1 is a longitudinal sectional view of a multi-chamber type heat treatment device according to an embodiment of the present disclosure when seen from a front side thereof.
Figure 2:
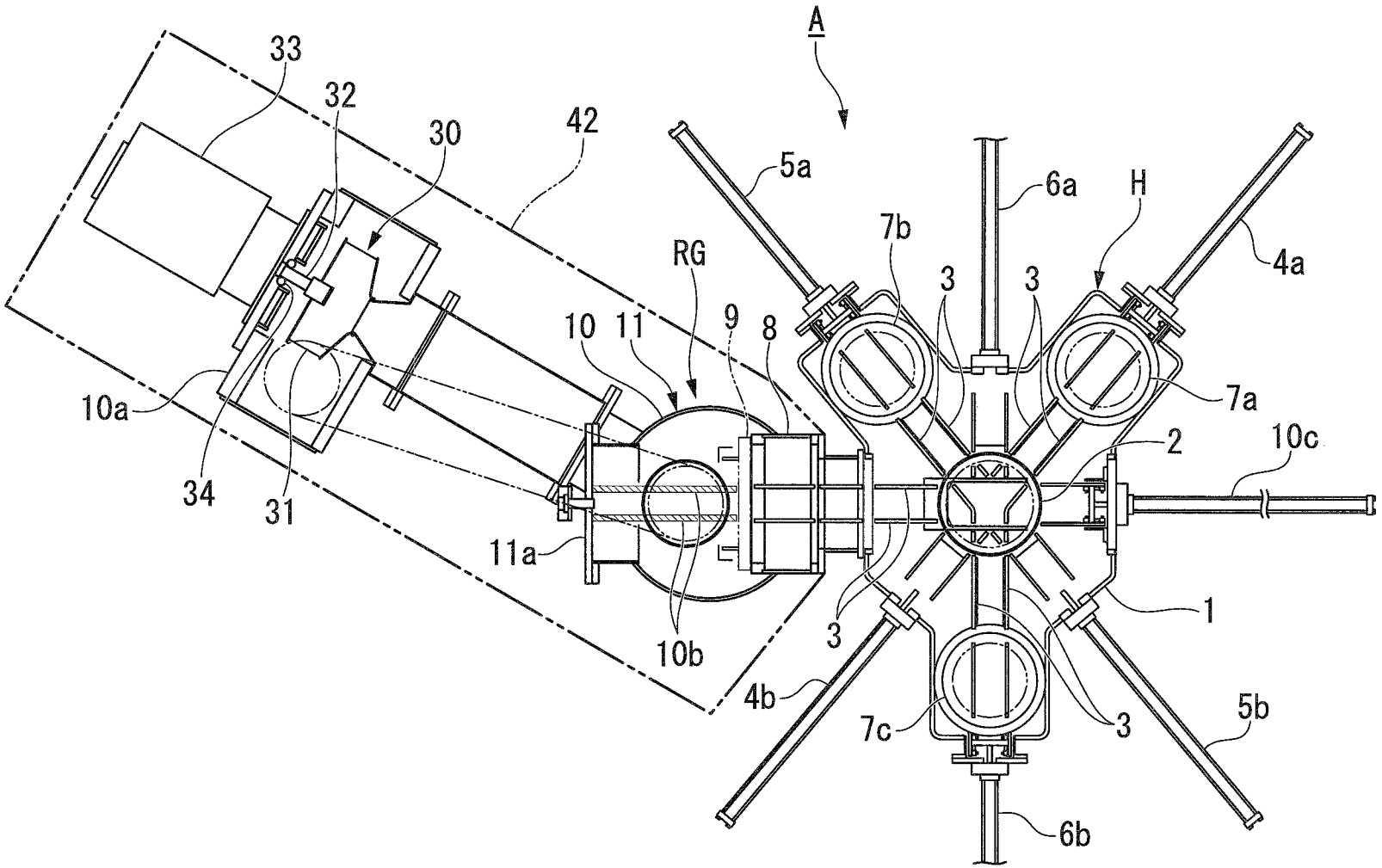
FIG. 2 is a cross-sectional view of the multi-chamber type heat treatment device according to the embodiment of the present disclosure when seen from an upper side thereof.

FIG. 1 is a longitudinal sectional view of a multi-chamber type heat treatment device A according to an embodiment of the present disclosure when seen from a front side thereof. FIG. 2 is a cross-sectional view of the multi-chamber type heat treatment device A according to the embodiment of the present disclosure when seen from an upper side thereof.

As shown in FIG. 1, the multi-chamber type heat treatment device A according to the embodiment is a device in which a gas cooling unit RG, a mist cooling unit RM and three heating units K are coupled through an intermediate conveying unit H.

As shown in FIGS. 1 and 2, the intermediate conveying unit H includes a conveying chamber 1, a mist cooling chamber lifting table 2, a plurality of conveying rails 3, three pairs of pusher mechanisms 4*a*, 4*b*, 5*a*, 5*b*, 6*a* and 6*b*, three heating chamber lifting tables 7*a* to 7*c*, an expansion chamber 8 and a partition door 9.

The conveying chamber 1 is provided between the mist cooling unit RM and the three heating units K. As shown in FIG. 2, the three heating chamber lifting tables 7*a* to 7*c* are disposed on a bottom portion of the conveying chamber 1 to surround the mist cooling chamber lifting table 2. An internal space of the conveying chamber 1 and an internal space of the expansion chamber 8 which will be described below serve as an intermediate conveying chamber in which an object X to be treated is moved.

The mist cooling chamber lifting table 2 is a support table on which the object X to be treated is loaded when the object X to be treated is cooled by the mist cooling unit RM, and is lifted by a lifting mechanism that is not shown in the drawings. That is, the object X to be treated is moved between the intermediate conveying unit H and the mist cooling chamber lifting table 2 by an operation of the lifting mechanism while loaded on the mist cooling chamber lifting table 2.

As shown in the drawings, the plurality of conveying rails 3 are installed on the bottom portion of the conveying chamber 1, the mist cooling chamber lifting table 2, the heating chamber lifting tables 7*a* to 7*c*, and a bottom portion of the expansion chamber 8. The conveying rails 3 serve as guide members (guiding members) for moving the object X to be treated in the conveying chamber 1 and the expansion chamber 8. The three pairs of pusher mechanisms 4*a*, 4*b*, 5*a*, 5*b*, 6*a* and 6*b* serve as conveying actuators which press the object X to be treated in the conveying chamber 1 and the expansion chamber 8.

That is, among the three pairs of pusher mechanisms 4*a*, 4*b*, 5*a*, 5*b*, 6*a* and 6*b*, the mechanisms which are arranged on the same straight line move the object X to be treated between the mist cooling chamber lifting table 2 and the corresponding one of the three heating chamber lifting tables 7*a* to 7*c*. For example, one pusher mechanism 4*a* of the pair of pusher mechanisms 4*a* and 4*b* presses the object X to be treated from the heating chamber lifting table 7*a* toward the mist cooling chamber lifting table 2, and the other pusher mechanism 4*b* presses the object X to be treated from the mist cooling chamber lifting table 2 toward the heating chamber lifting table 7*a*.

The plurality of conveying rails 3 guide the object X to be treated to move smoothly when the object X to be treated is moved (conveyed) using the three pairs of pusher mechanisms 4*a*, 4*b*, 5*a*, 5*b*, 6*a* and 6*b*. The plurality of conveying rails 3 also guide movement of a pressing part which is installed at each of front ends of the three pairs of pusher mechanisms 4*a*, 4*b*, 5*a*, 5*b*, 6*a* and 6*b*.

The three heating chamber lifting tables 7*a* to 7*c* are support tables on which the object X to be treated is loaded when the object X to be treated is heated by each of the heating units K, and are provided just below each of the heating units K. The heating chamber lifting tables 7*a* to 7*c* are lifted up and down by lifting mechanisms which are not shown, thereby moving the object X to be treated between the intermediate conveying unit H and each of the heating units K.

The three heating units K perform heating treatment on the object X to be treated and are provided above the conveying chamber 1. Each of the three heating units K has a heating chamber, a plurality of electric heaters and so on provided therein, and evenly heats the object X to be treated, which is loaded on each of the heating chamber lifting tables 7*a* to 7*c* and is accommodated in the heating chamber, under a predetermined reduced pressure atmosphere.

The mist cooling unit RM performs cooling treatment on the object X to be treated using a mist of a predetermined cooling medium and is provided below the conveying chamber 1. The mist cooling unit RM has a mist cooling chamber provided therein and cools (mist-cools) the object X to be treated, which is loaded on the mist cooling chamber lifting table 2 and is accommodated in the mist cooling chamber, by spraying the mist of the cooling medium from a plurality of nozzles provided around the object X to be treated. The cooling medium is, for example, water.

The expansion chamber 8 is an approximately box-shaped expansion container which is connected to a side portion of the conveying chamber 1 and is conveniently provided for connecting the intermediate conveying unit H with the gas cooling unit RG One end of the expansion chamber 8 is in communication with the side portion of the conveying chamber 1, and the partition door 9 is provided at the other end of the expansion chamber 8. Further, the conveying rail 3 for moving the object X to be treated is installed on the bottom portion of the expansion chamber 8.

The partition door 9 partitions the intermediate conveying chamber, which is the internal space of the expansion chamber 8, and a gas cooling chamber 10 (heat treatment chamber) of the gas cooling unit RG and is vertically provided on the other end of the expansion chamber 8. That is, the partition door 9 is moved up and down by a driving mechanism which is not shown, thereby opening or closing the other end of the expansion chamber 8.

Next, the gas cooling unit RG will be described. The gas cooling unit RG cools the object X to be treated using a cooling gas, and hydrogen gas ($H_2$ gas) is used as the cooling gas. As shown in FIG. 1, the gas cooling unit RG includes the gas cooling chamber 10, a cooling gas supply unit 20, a cooling gas circulation unit 30, a gas purge unit 40, a hydrogen gas recovery unit 50 and so on.

The gas cooling chamber 10 includes an object accommodation part 11, a cooling gas circulation part 12, a heat exchange part 13 and so on. The object accommodation part 11 is a container which has a shape having high pressure resistance, i.e., an approximately cylindrical shape both end surfaces of which are rounded, and is provided longitudinally (so that a radial direction thereof becomes horizontal) to be adjacent to the expansion chamber 8 which constitutes the intermediate conveying chamber.

The object accommodation part 11 is connected to the expansion chamber 8 in a state in which a part of the expansion chamber 8 is accommodated therein, i.e., a state in which the partition door 9 protrudes into the gas cooling chamber 10 from a side of the gas cooling chamber 10. Additionally, in the object accommodation part 11, a workpiece entrance door 11*a* is provided at a position facing the partition door 9. The workpiece entrance door 11*a* opens and closes a workpiece entrance through which the object X to be treated is put in and taken out between an outside and an inside of the gas cooling chamber.

A mounting table 10*b* which holds the object X to be treated at a predetermined height is provided at an inner side of the workpiece entrance door 11*a*. The object X to be treated which is held on the mounting table 10*b* is moved by an entrance cylinder mechanism 10*c* shown in FIG. 2. The entrance cylinder mechanism 10*c* is a conveying mechanism which moves the object X to be treated between the object accommodation part 11 and the conveying chamber 1.

The cooling gas circulation part 12 is an annular container which connects the object accommodation part 11 with the heat exchange part 13. As shown in FIG. 1, one end (a gas blowing port 12*a*) of the cooling gas circulation part 12 is opened to an upper portion (an upper side) of the object accommodation part 11, and the other end (a gas exhaust port 12*b*) of the cooling gas circulation part 12 is opened to a lower portion (a lower side) of the object accommodation part 11 to face the gas blowing port 12*a* while the object X to be treated is interposed therebetween.

A vacuum pump 12*d* is connected to the cooling gas circulation part 12 via an exhaust pipe 12*c*. The vacuum pump 12*d* exhausts a gas in the gas cooling chamber 10 to an outside through the exhaust pipe 12*c*. For example, a roots pump may be used as the vacuum pump 12*d*. An opening and closing valve 12*c*1 which controls exhaust of the gas is provided at the exhaust pipe 12*c* disposed between the cooling gas circulation part 12 and the vacuum pump 12*d*. A downstream side of the vacuum pump 12*d* is branched into an atmosphere open pipe 12*e* and a hydrogen gas recovery pipe 12*f*. An opening and closing valve 12*e*1 is provided at the atmosphere open pipe 12*e*, and an opening and closing valve 12*f*1 is provided at the hydrogen gas recovery pipe 12*f*.

The heat exchange part 13 is provided at the cooling gas circulation part 12 located downstream from (at an exhaust side of) the gas exhaust port 12*b* and has a heat exchanger 13*a*. The heat exchanger 13*a* has a plurality of heat transfer pipes which are provided meanderingly, and a liquid refrigerant is inserted thereinto. The heat exchange part 13 cools the cooling gas by allowing the cooling gas, which flows from one end of the cooling gas circulation part 12 toward the other end of the cooling gas circulation part 12 via the object accommodation part 11, to exchange heat with the liquid refrigerant in the heat transfer pipes. In the heat exchange part 13, the cooling gas heated by the object X to be treated is cooled to, for example, a temperature from before it was provided to cool the object X to be treated (a temperature of the cooling gas blown out from the gas blowing port 12*a*).

The cooling gas supply unit 20 includes a supply tank 21, a cooling gas supply pipe 22, an opening and closing valve 23 and so on. The supply tank 21 stores the hydrogen gas, which is used as the cooling gas, in a high pressure state. The supply tank 21 is connected to the gas cooling chamber 10 through the cooling gas supply pipe 22. The opening and closing valve 23 allows/blocks passage of the cooling gas in the cooling gas supply pipe 22. When the opening and closing valve 23 is in a closed state, supply of the cooling gas from the supply tank 21 into the gas cooling chamber 10 is blocked, and when the opening and closing valve 23 is in an opened state, the cooling gas is supplied from the supply tank 21 into the gas cooling chamber 10.

The cooling gas circulation unit 30 includes a turbo fan 31 (an impeller), a rotary shaft 32, a motor 33, a seal member 34 and so on. The turbo fan 31 is a centrifugal fan which is provided in the gas cooling chamber 10. The rotary shaft 32 extends horizontally, passes through a wall portion 10*a* of the gas cooling chamber 10 and is connected to the turbo fan 31. The motor 33 is a power source which rotates the rotary shaft 32 and is provided outside the gas cooling chamber 10. For example, a water cooling motor may be used as the motor.

The motor 33 includes a gas introduction part 33*a* which introduces an inert gas thereinto, and a gas exhaust part 33*b* which discharges the inert gas from an inside thereof. The gas introduction part 33*a* and the gas exhaust part 33*b* are openings provided at a housing of the motor 33 which accommodates a rotor and a stator. The seal member 34 is provided around the rotary shaft 32 and seals between the gas cooling chamber 10 and the motor 33. For example, a segment seal may be used as the seal member 34.

The gas purge unit 40 allows at least the motor 33 to be gas-purged with the inert gas. The gas purge unit 40 includes a supply tank 41, a gas purge chamber 42, a first gas purge pipe 43, a second gas purge pipe 44, a third gas purge pipe 45 and so on. The supply tank 41 stores the inert gas, which is used for gas purge, in a high pressure state. Nitrogen gas, argon gas or the like may be used as the inert gas, and in the embodiment, the supply tank 41 stores the relatively inexpensive nitrogen gas ($N_2$ gas).

The gas purge chamber 42 is a container which sealingly surrounds at least the motor 33. In the embodiment, the gas purge chamber 42 is configured to surround the gas cooling chamber 10 together with the motor 33. Specifically, the gas purge chamber 42 is formed to have approximately a box shape and surrounds the motor 33 and an upper surface and four side surfaces of the gas cooling chamber 10, as shown in FIGS. 1 and 2. Additionally, the gas purge chamber 42 also surrounds at least a part of the expansion chamber 8 outside the partition door 9. An exhaust pipe 42*a* is provided at an upper surface of the gas purge chamber 42. The exhaust pipe 42*a* has a safety valve which is opened when a pressure is reached at a predetermined value of, for example, 1.1 bar or more.

The first gas purge pipe 43 supplies the inert gas into the motor 33. The first gas purge pipe 43 connects the supply tank 41 with the gas introduction part 33*a* of the motor 33. An opening and closing valve 43*a* is provided at the first gas purge pipe 43. The opening and closing valve 43*a* allows/blocks passage of the inert gas in the first gas purge pipe 43. When the opening and closing valve 43*a* is in a closed state, supply of the inert gas from the supply tank 41 into the motor 33 is blocked, and when the opening and closing valve 43*a* is in an opened state, the inert gas is supplied from the supply tank 41 into the motor 33.

The second gas purge pipe 44 supplies the inert gas into the gas purge chamber 42. The second gas purge pipe 44 connects the supply tank 41 with the gas purge chamber 42. An opening and closing valve 44*a* is provided at the second gas purge pipe 44. The opening and closing valve 44*a* allows/blocks passage of the inert gas in the second gas purge pipe 44. When the opening and closing valve 44*a* is in a closed state, supply of the inert gas from the supply tank 41 into the gas purge chamber 42 is blocked, and when the opening and closing valve 44*a* is in an opened state, the inert gas is supplied from the supply tank 41 into the gas purge chamber 42.

The third gas purge pipe 45 supplies the inert gas into the gas cooling chamber 10. The third gas purge pipe 45 connects the supply tank 41 with the gas cooling chamber 10. An opening and closing valve 45*a* is provided at the third gas purge pipe 45. The opening and closing valve 45*a* allows/blocks passage of the inert gas in the third gas purge pipe 45. When the opening and closing valve 45*a* is in a closed state, supply of the inert gas from the supply tank 41 into the gas cooling chamber 10 is blocked, and when the opening and closing valve 45*a* is in an opened state, the inert gas is supplied from the supply tank 41 into the gas cooling chamber 10.

Next, the constitution of the hydrogen gas recovery unit 50 will be described with reference to FIG. 3.

Figure 3:
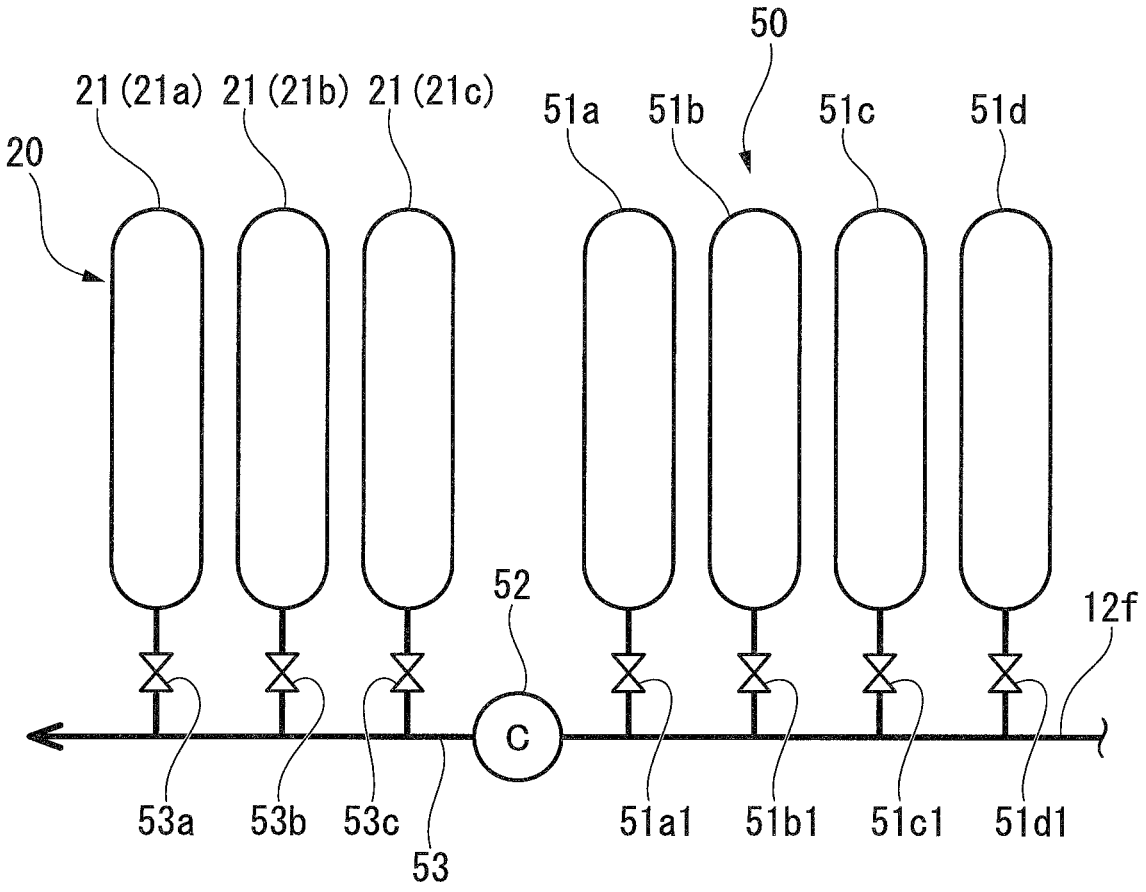
FIG. 3 is a view showing a schematic constitution of a hydrogen gas recovery unit according to the embodiment of the present disclosure.

FIG. 3 is a view showing a schematic constitution of the hydrogen gas recovery unit 50 according to one embodiment of the present disclosure.

The hydrogen gas recovery unit 50 recovers the hydrogen gas which is supplied as the cooling gas into the gas cooling chamber 10. As shown in FIG. 1, the hydrogen gas recovery unit 50 of the embodiment is connected to the hydrogen gas recovery pipe 12*f* disposed downstream from the vacuum pump 12*d* and supplies the recovered hydrogen gas into the supply tank 21 of the cooling gas supply unit 20.

As shown in FIG. 3, the hydrogen gas recovery unit 50 includes a plurality of recovery tanks 51*a* to 51*d*, a compressor 52, a hydrogen gas supply pipe 53 and so on. The plurality of recovery tanks 51*a* to 51*d* are connected to the hydrogen gas recovery pipe 12*f* through pipes having opening and closing valves 51*a*1 to 51*d*1, respectively. For example, the opening and closing valve 51*a*1 allows/blocks passage of the hydrogen gas to the recovery tank 51*a*. When the opening and closing valve 51*a*1 is in a closed state, supply of the hydrogen gas from the hydrogen gas recovery pipe 12*f* into the recovery tank 51*a* is blocked, and when the opening and closing valve 51*a*1 is in an opened state, the hydrogen gas is supplied from the hydrogen gas recovery pipe 12*f* into the recovery tank 51*a*.

Among the plurality of recovery tanks 51*a* to 51*d*, the recovery tanks 51*a* to 51*c* (first recovery tanks) are provided to recover the hydrogen gas in the gas cooling chamber 10 by performing a pressure equalizing operation multiple times (three times in the embodiment (this will be described below)). The recovery tank 51*d* (second recovery tank) is provided to recover the hydrogen gas in the gas cooling chamber 10 by driving of the vacuum pump 12*d* after the pressure equalizing operation is performed multiple times. The compressor 52 pressurizes the hydrogen gas recovered in the plurality of recovery tanks 51*a* to 51*d* and then supplies the pressurized hydrogen gas to the cooling gas supply unit 20.

The hydrogen gas supply pipe 53 supplies the hydrogen gas pressurized by the compressor 52 into the supply tank 21 of the cooling gas supply unit 20. The supply tank 21 of the embodiment includes a plurality of supply tanks 21*a* to 21*c*. Opening and closing valves 53*a* to 53*c* provided at the hydrogen gas supply pipe 53 allow/block passage of the hydrogen gas into the supply tanks 21*a* to 21*c*, respectively. For example, when the opening and closing valve 53*a* is in a closed state, supply of the hydrogen gas from the hydrogen gas supply pipe 53 into the supply tank 21*a* is blocked, and when the opening and closing valve 53*a* is in an opened state, the hydrogen gas is supplied from the hydrogen gas supply pipe 53 into the supply tank 21*a*.

Next, an operation of the multi-chamber type heat treatment device A having the above-described constitution, in particular, a cooling operation of the object X to be treated in the gas cooling chamber 10, will be described in detail.

First, a worker places the object X to be treated in the object accommodation part 11 (gas cooling chamber) through the workpiece entrance door 11*a*. Then, the worker closes airtightly the workpiece entrance door 11*a*, sets a heat treatment condition by manually operating an operation panel which is not shown and also instructs a controller which is not shown to start a heat treatment operation. The controller moves the object X to be treated to the heating unit K and performs a heating process on the basis of the set heat treatment condition. If necessary, the object X to be treated after the heating process is mist-cooled by the mist cooling unit RM, is then conveyed to the gas cooling unit RG by the entrance cylinder mechanism 10*c*, and is disposed between the gas blowing port 12*a* and the gas exhaust port 12*b* while held on the mounting table 10*b*.

Then, the controller drives the gas cooling unit RG to gas-cool the object X to be treated. Specifically, the controller drives the cooling gas supply unit 20 to supply the hydrogen gas into the gas cooling chamber 10. When the opening and closing valve 23 is switched from the closed state to the opened state by the controller, the hydrogen gas is supplied from the cooling gas supply pipe 22 into the gas cooling chamber 10. When a predetermined amount of hydrogen gas is supplied into the gas cooling chamber 10, the controller switches the opening and closing valve 23 from the opened state to the closed state, drives the cooling gas circulation unit 30 to start circulation of the hydrogen gas and thus starts a cooling process of the object X to be treated according to the heat treatment condition.

When the cooling gas circulation unit 30 is driven, a flow of the hydrogen gas (clockwise in the example of FIG. 1) as indicated by an arrow in FIG. 1 occurs. The hydrogen gas flowing downward from the gas blowing port 12*a* is blown toward the object X to be treated from an upper side thereof to cool the object X to be treated. Then, the hydrogen gas which contributes to the cooling of the object X to be treated flows out to a lower side of the object X to be treated and flows into the gas exhaust port 12*b*, and is guided to the heat exchange part 13. The hydrogen gas is cooled by the heat exchange part 13 and is then circulated by the cooling gas circulation part 12.

As described above, in the embodiment, the hydrogen gas is used as the cooling gas for the cooling process of the object X to be treated, and the object X to be treated is cooled by circulating the hydrogen gas in the gas cooling chamber 10. Since the hydrogen gas has a heat transfer rate of about 2.2 times that of nitrogen gas, the cooling capacity can be enhanced even if the pressure of the cooling gas is reduced. For example, assuming that the gas cooling chamber 10 has a volume of 2 $m^3$, each of the supply tanks 21*a* to 21*c* has a volume of 1.5 $m^3$ and a pressure of the hydrogen gas stored in each of the supply tanks 21*a* to 21*c* is 10 bar, a pressure in the gas cooling chamber 10 when the opening and closing valve 23 is opened is about 6.9 bar. In order to achieve such cooling capacity with the nitrogen gas, a pressure of about 15.2 bar is required.

Meanwhile, when the hydrogen gas is mixed with oxygen gas, the hydrogen gas may be ignited and burnt by even a slight spark. Therefore, in the embodiment, the seal member 34 is provided around the rotary shaft 32 which is rotated by the motor 33 of the cooling gas circulation unit 30 to seal a space between the motor 33 and the gas cooling chamber 10 in which the hydrogen gas is contained. Further, since it is difficult to completely airtightly seal around the rotary shaft 32, in the embodiment, the gas purge unit 40 is provided to allow an inside of the motor 33 to be gas-purged with the inert gas, thereby reliably preventing mixing of the hydrogen gas and the oxygen gas in the motor 33. Accordingly, the hydrogen gas can be safely used as the cooling gas.

Specifically, the gas purge unit 40 includes the first gas purge pipe 43 which supplies the nitrogen gas into the motor 33, the gas purge chamber 42 which surrounds at least the motor 33, and the second gas purge pipe 44 which supplies the nitrogen gas into the gas purge chamber 42. According to such a constitution, since the atmosphere in the motor 33 is replaced with the nitrogen gas and the atmosphere outside the motor 33 is also replaced with the nitrogen gas, the hydrogen gas and the oxygen gas can be reliably prevented from being mixed in the motor 33 and therearound.

Also, in the embodiment, since the gas purge chamber 42 surrounds the gas cooling chamber 10 together with the motor 33, it is possible to entirely surround a portion which uses the hydrogen gas including the gas cooling chamber 10. Further, in the embodiment, since the gas purge chamber 42 also surrounds a part of the expansion chamber 8 outside the partition door 9 which partitions between the gas cooling chamber 10 and the expansion chamber 8, the mixing of the hydrogen gas and the oxygen gas can be reliably prevented. Furthermore, since the gas purge chamber 42 has the exhaust pipe 42*a* having the safety valve, a pressure can be reduced to a predetermined value or less even when the hydrogen gas leaks into the gas purge chamber 42, and thus the hydrogen gas can be reliably prevented from being spontaneously ignited.

Since the hydrogen gas has the higher cooling capacity than the nitrogen gas but is more expensive than the nitrogen gas, it is preferable to reduce consumption of the hydrogen gas. Therefore, in the embodiment, the hydrogen gas recovery unit 50 which recovers the hydrogen gas supplied into the gas cooling chamber 10 is provided.

Figure 4:
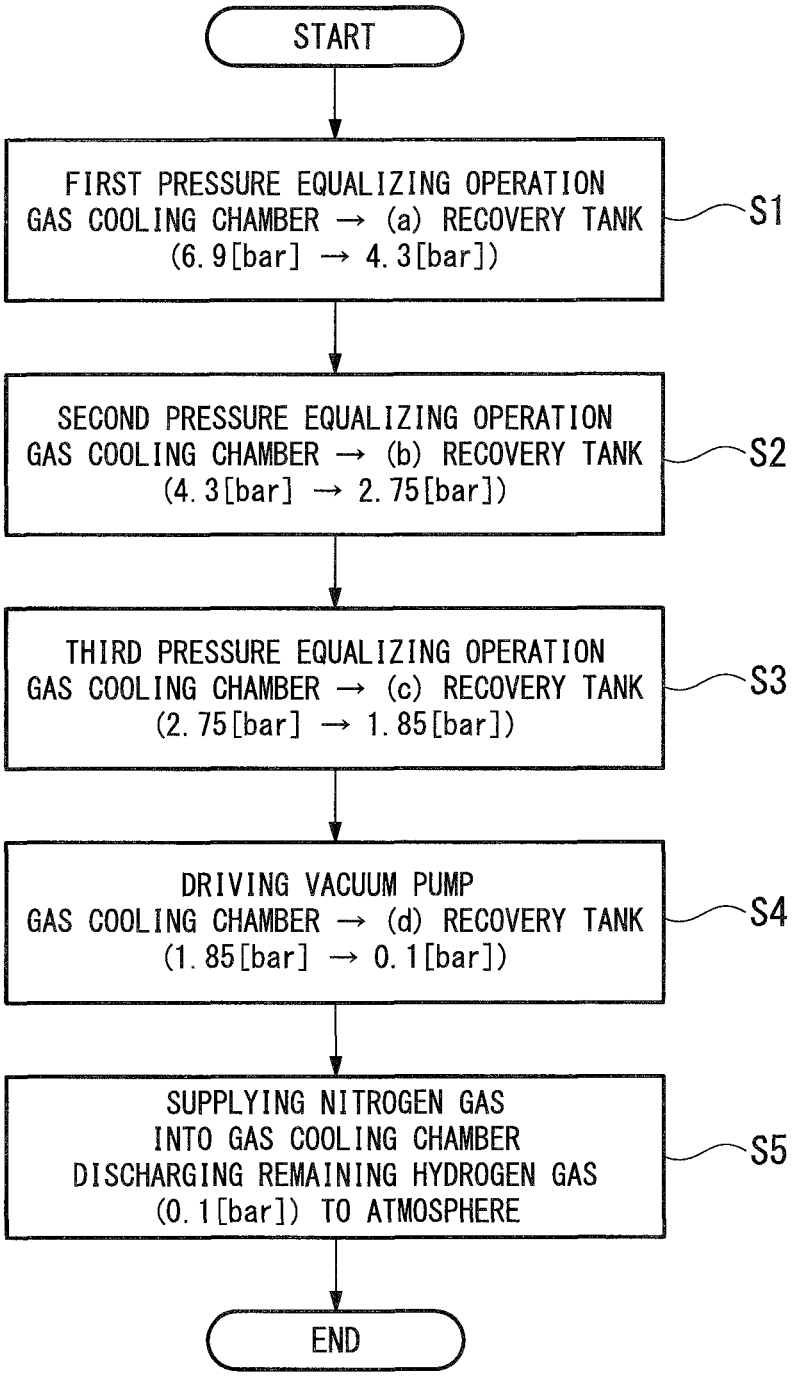
FIG. 4 is a flowchart of a recovery operation of hydrogen gas according to the embodiment of the present disclosure.

FIG. 4 is a flowchart of a recovery operation of the hydrogen gas according to one embodiment of the present disclosure. In the following description, it is assumed that a volume of each of the plurality of recovery tanks 51*a* to 51*d* is 1 $m^3$.

In the recovery operation of the hydrogen gas, first, the opening and closing valve 51*a*1 shown in FIG. 3 is opened so that the recovery tank 51*a* communicates with the gas cooling chamber 10 (a first pressure equalizing operation: step S1). As a result, the pressure in the gas cooling chamber 10 is reduced from about 6.9 bar to about 4.3 bar.

Then, the opening and closing valve 51*a*1 is closed, and the opening and closing valve 51*b*1 is opened so that the recovery tank 51*b* communicates with the gas cooling chamber 10 (a second pressure equalizing operation: step S2). As a result, the pressure in the gas cooling chamber 10 is reduced from about 4.3 bar to about 2.75 bar.

Then, the opening and closing valve 51*b*1 is closed, and the opening and closing valve 51*c*1 is opened so that the recovery tank 51*c* communicates with the gas cooling chamber 10 (a third pressure equalizing operation: step S3). As a result, the pressure in the gas cooling chamber 10 is reduced from about 2.75 bar to about 1.85 bar.

In this way, the hydrogen gas recovery unit 50 recovers the hydrogen gas in the gas cooling chamber 10 into the recovery tanks 51*a* to 51*c* by performing the pressure equalizing operation multiple times. As a result, about 75% of the hydrogen gas can be recovered.

Then, the opening and closing valve 51*c*1 is closed, and the opening and closing valve 51*d*1 is opened so that the recovery tank 51*d* communicates with the gas cooling chamber 10. Additionally, the vacuum pump 12*d* is driven, and the hydrogen gas in the gas cooling chamber 10 is forcibly recovered into the recovery tank 51*d* (step S4). As a result, the pressure in the gas cooling chamber 10 is reduced from about 1.85 bar to about 0.1 bar.

As described above, after the pressure equalizing operation is performed multiple times, the hydrogen gas recovery unit 50 recovers the hydrogen gas in the gas cooling chamber 10 by the driving of the vacuum pump 12*d*. As a result, about 99% of the hydrogen gas can be recovered.

After the driving of the vacuum pump 12*d*, the nitrogen gas is supplied into the gas cooling chamber 10 through the third gas purge pipe 45, and the hydrogen gas which is not recovered is discharged to the atmosphere (step S5). Thus, the recovery operation of the hydrogen gas is completed.

The hydrogen gas recovered in the plurality of recovery tanks 51*a* to 51*d* is pressurized by the compressor 52 shown in FIG. 3 and is supplied as the cooling gas into any one of the supply tanks 21*a* to 21*c* of the cooling gas supply unit 20. Accordingly, the hydrogen gas can be reused, and thus a running cost of the gas cooling unit RG can be reduced.

As described above, the above-described embodiment discloses the multi-chamber type heat treatment device A which includes the gas cooling chamber 10 which accommodates the object X to be treated, the cooling gas supply unit 20 which supplies the cooling gas into the gas cooling chamber 10, and the cooling gas circulation unit 30 which circulates the cooling gas in the gas cooling chamber 10. Further, the cooling gas supply unit 20 supplies the hydrogen gas as the cooling gas into the gas cooling chamber 10. By using the above-described constitution, the cooling capacity can be enhanced even when the pressure of the cooling gas is reduced.

Further, the cooling gas circulation unit 30 includes the turbo fan 31 which is provided in the gas cooling chamber 10, the rotary shaft 32 which passes through the wall portion 10*a* of the gas cooling chamber 10 and is connected to the turbo fan 31, the motor 33 which is provided outside the gas cooling chamber 10 and is configured to rotate the rotary shaft 32, and the gas purge unit 40 which gas-purges at least the motor 33 with the inert gas. By using the above-described constitution, the mixing of the hydrogen gas and the oxygen gas is reliably prevented, and the hydrogen can be safely used as the cooling gas.

The present disclosure is not limited to the above-described embodiment, and for example, the following modified example can be considered.

(1) In the above-described embodiment, it has been described that the gas purge chamber 42 surrounds the gas cooling chamber 10 together with the motor 33, but the present disclosure is not limited thereto. For example, the gas purge chamber 42 may have a constitution which surrounds at least the motor 33. That is, as long as there is provided the gas purge unit which gas-purges, with the inert gas, a portion (the motor 33 in the embodiment) in which there is a possibility of mixing of the cooling gas (the hydrogen gas) supplied into the gas cooling chamber 10 (the heat treatment chamber) and the oxygen gas, the mixing of the hydrogen gas and the oxygen gas is reliably prevented, and the hydrogen gas can be safely used as the cooling gas.

(2) Further, in the above-described embodiment, the constitution in which the seal member 34 is provided around the rotary shaft 32 of the motor 33 has been described. However, if the gas purge of the motor 33 is sufficient, the seal member 34 may not be provided, and it may not be necessary to isolate between the housing of the motor 33 and the gas cooling chamber 10. In addition, as long as the seal member 34 which is provided around the rotary shaft 32 of the motor 33 can hold the pressure in the gas cooling chamber 10 (allowing some gas leakage), the housing of the motor 33 may not be provided.

(3) Further, in the above-described embodiment, it has been described that the hydrogen gas recovery unit 50 performs the pressure equalizing operation three times, but the present disclosure is not limited thereto. For example, the pressure equalizing operation may be performed one time, two times or four times or more.

INDUSTRIAL APPLICABILITY

According to the present disclosure, it is possible to obtain a heat treatment device which can enhance the cooling capacity even when the pressure of the cooling gas is reduced. Furthermore, the hydrogen gas can be safely used as the cooling gas.

What is claimed is:

1. A heat treatment device comprising:

a heat treatment chamber which accommodates an object to be treated;

a cooling gas supply unit which supplies a cooling gas into the heat treatment chamber;

a cooling gas circulation unit which includes an impeller which is provided in the heat treatment chamber, a rotary shaft which passes through a wall portion of the heat treatment chamber and is connected to the impeller, and a motor which is provided outside the heat treatment chamber and is configured to rotate the rotary shaft, and circulates the cooling gas in the heat treatment chamber, the motor having a housing which accommodates a rotor and a stator of the motor, and a gas introduction part and a gas exhaust part which are provided at the housing of the motor; and a gas purge unit which supplies an inert gas to the gas introduction part and gas-purges, with the inert gas, at least an inside of the housing of the motor, wherein the cooling gas supply unit supplies a hydrogen gas into the heat treatment chamber as the cooling gas.

2. The heat treatment device according to claim 1, wherein the gas purge unit includes a first gas purge pipe which supplies the inert gas into the motor, a gas purge chamber which surrounds at least the motor, and a second gas purge pipe which supplies the inert gas into the gas purge chamber.

3. The heat treatment device according to claim 2, wherein the gas purge chamber surrounds the heat treatment chamber together with the motor.

4. The heat treatment device according to claim 1, further comprising a seal member which is provided around the rotary shaft and seals between the heat treatment chamber and the motor.

5. The heat treatment device according to claim 1, further comprising a hydrogen gas recovery unit which recovers the hydrogen gas supplied into the heat treatment chamber.

6. The heat treatment device according to claim 5, wherein the hydrogen gas recovery unit includes a first recovery tank which recovers the hydrogen gas in the heat treatment chamber by a pressure equalizing operation.

7. The heat treatment device according to claim 6, wherein the hydrogen gas recovery unit further includes a second recovery tank which recovers the hydrogen gas in the heat treatment chamber by driving of a vacuum pump after the pressure equalizing operation.

8. The heat treatment device according to claim 6, further comprising a compressor which pressurizes the hydrogen gas recovered in the first recovery tank and supplies the pressurized hydrogen gas as the cooling gas into the cooling gas supply unit.

9. The heat treatment device according to claim 7, further comprising a compressor which pressurizes the hydrogen gas recovered in the first and second recovery tanks and supplies the pressurized hydrogen gas as the cooling gas into the cooling gas supply unit.

* * * * *